US006109581A

United States Patent [19]

Kracke et al.

[11] Patent Number: 6,109,581

[45] Date of Patent: Aug. 29, 2000

[54] INVERTED CONTAINER HOLDER

[76] Inventors: David R. Kracke, 2155 NE. 79th Ave., Portland, Oreg. 97213; Robert W. DeLorenzo, 29438 Stonecrest Rd., Rancho Palos Verdes, Calif. 90275

[21] Appl. No.: 09/083,804

[22] Filed: May 22, 1998

Related U.S. Application Data

[63] Continuation-in-part of application No. 08/720,113, Sep. 27, 1996, Pat. No. 5,755,418, which is a continuation of application No. 08/372,815, Dec. 23, 1994, abandoned.

[51] Int. Cl.[7] ..... A47K 1/08

[52] U.S. Cl. ..... 248/311.3; 211/74

[58] Field of Search ..... 248/311.3, 311.2, 248/312, 314, 346.11, 310, 346.5, 519, 146, 154; 211/74, 75; D7/619, 624

[56] References Cited

U.S. PATENT DOCUMENTS

| | | | |
|---|---|---|---|
| 493,161 | 3/1893 | Grau | 431/296 |
| 2,211,746 | 8/1940 | Young | 248/311.2 |
| 2,285,953 | 2/1942 | Smith | 229/1.5 H |
| 2,784,577 | 3/1957 | Beaham, III | 248/146 |
| 3,731,819 | 5/1973 | Sandhage | 211/74 |
| 4,026,508 | 5/1977 | Ziegler | 248/220.22 |
| 4,271,878 | 6/1981 | Belega | 141/375 |
| 4,347,879 | 9/1982 | Blaser | 141/364 |
| 4,678,149 | 7/1987 | Chase | 248/150 |
| 4,795,211 | 1/1989 | Stern et al. | 297/188.18 |
| 4,801,060 | 1/1989 | Thompson | 224/275 |
| 4,854,468 | 8/1989 | Dahlquist, II et al. | 220/737 |
| 4,960,254 | 10/1990 | Hartke | 248/146 |
| 4,971,209 | 11/1990 | Todd | 211/74 |
| 5,065,966 | 11/1991 | Hartke | 248/146 |
| 5,071,002 | 12/1991 | Bradley | 206/217 |
| 5,078,346 | 1/1992 | Deichman | 248/351 |
| 5,088,673 | 2/1992 | Chandler | 248/311.2 |
| 5,141,194 | 8/1992 | Burgess et al. | 248/311.2 |
| 5,149,041 | 9/1992 | Hartke | 248/146 |
| 5,174,534 | 12/1992 | Mitchell | 248/311.2 |
| 5,199,681 | 4/1993 | Reidy | 248/488 |
| 5,297,600 | 3/1994 | Downes et al. | 141/364 |
| 5,439,193 | 8/1995 | Coulter et al. | 248/206.3 |
| 5,447,764 | 9/1995 | Langford | 428/36.9 |
| 5,794,904 | 8/1998 | Hackley | 248/311.3 |

*Primary Examiner*—Ramon O. Ramirez
*Assistant Examiner*—Anita M. King
*Attorney, Agent, or Firm*—Kolisch, Hartwell, Dickinson, McCormack & Heuser

[57] ABSTRACT

A device for holding an inverted bottle or container is described. The device includes a cylindrically shaped tube with an outer wall of consistent diameter in the upward direction. The vessel may have ridges on an internal side to engage the top of an inverted container and to securely hold the container in an inverted position, allowing remaining material in the container to move by gravity to the container opening. The vessel is connected to a stabilizing structure or base in order to prevent the vessel form tipping over when loaded with a top heavy inverted container. The device is particularly useful for allowing extrication of remaining material from a nearly empty container, particularly relatively viscous material which is necessarily refrigerated.

7 Claims, 4 Drawing Sheets

INVERTED CONTAINER HOLDER

CROSS-REFERENCED TO RELATED APPLICATIONS

This application is a continuation-in-part of U.S. patent application Ser. No. 08/720,113, filed Sep. 27, 1996, issued as U.S. Pat. No. 5,755,418 on May 26, 1998, which is a continuation of U.S. patent application Ser. No. 08/372,815, filed on Dec. 23, 1994, now abandoned.

FIELD OF THE INVENTION

The present invention is a holder for inverted bottles and containers that allows bottles and containers to be stabilized when placed in an inverted position.

BACKGROUND OF THE INVENTION

The present invention addresses the problem of what to do when a bottle or container containing some useful product has been nearly depleted of that product whereby the product itself is located at the very bottom of the container or bottle when that container or bottle is standing on its base.

For example, a consumer purchases a bottle of salad dressing. After almost all of the salad dressing has been used, there still remains some salad dressing at the bottom of the bottle. The salad dressing remaining at the bottom of the bottle is extremely difficult and painstakingly slow to extricate from the bottle. Often times this last remaining salad dressing is thrown away by the consumer due to the difficulty in extricating it from the bottle.

The determined consumer will often balance the bottle on its top (inverted position) within the refrigerator or other area where the bottle is normally stored. However, a basic problem with the inversion technique results from the fact that bottle/containers are designed to be maximally stable in their upright position, i.e., to have a low center of gravity. Therefore, the bottle/containers inherently have high centers of gravity when inverted, and are thus unstable or prone to fall over. Because the bottles are generally shaped with a large base and a small head, this balancing act becomes precarious. The bottle itself often times falls over in the refrigerator or other storage area, knocking other items over in that storage area, and causing a general headache to the consumer. To prevent the bottle from falling over, the consumer will often times situate the bottle or container so that it is squeezed between other items within the storage area causing those other items to act as a brace for the inverted bottle or container.

Accordingly, an object of the present invention is to provide a device which allows a container with a relatively high center of gravity to be securely supported in an inverted position.

Another object is to provide a device which simplifies the process of removing remaining material from a nearly empty container.

Another object is to minimize spills, waste and complications which typically occur in the process of attempting to remove the last remaining material from a nearly empty container, particularly containers which hold typically refrigerated relatively viscous materials.

SUMMARY OF THE INVENTION

The above-stated objects can be accomplished with an inverted container holder including a hollow cylindrically shaped tube secured to a round base piece. In a preferred embodiment, the diameter of the base is approximately twice the diameter of the tube, thereby providing stability when an inverted bottle is placed into the holder. The height of the tube is approximately one and one half times its diameter.

DETAILED DESCRIPTION OF THE DRAWINGS

Figure 1:
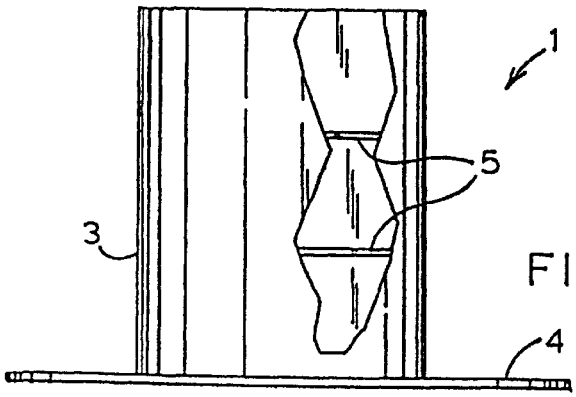
FIG. 1 is a side view of a holder for inverted bottles/containers in accordance with the present invention.
Figure 2:
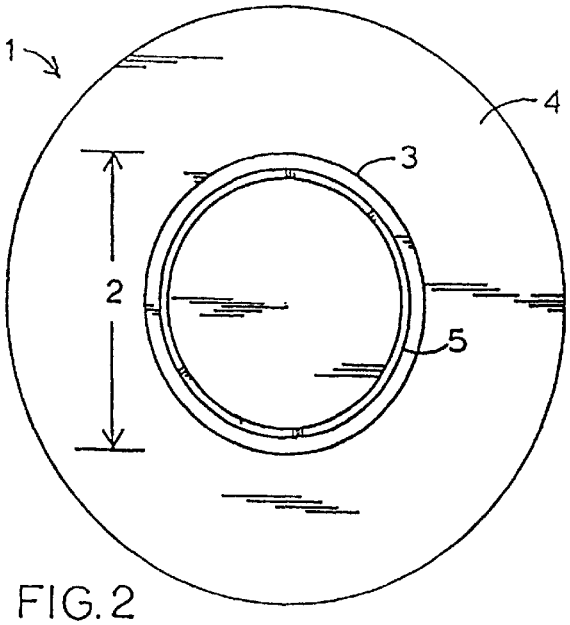
FIG. 2 is a top view of the holder shown in FIG. 1.

With reference to FIGS. 1 and 2 which are overall drawings of a preferred embodiment of the invention, a holder for inverted bottles/containers 1 of the present invention includes a hollow conical shaped piece (or tube) 3 mounted on top of a round base 4. The diameter 2 of tube 3 is approximately one half of the diameter of base 4. For purposes of illustration, these drawings show a holder for inverted bottles and containers whose tube is two inches in diameter and whose base is four inches in diameter with a cylindrical height of two and one half inches. Tube 3 may include internal ridge lines 5 that protrude from its interior surface approximately one eighth of an inch at intervals of approximately one half inch from the top of the cylindrical piece 3 to the base 4.

Figure 4:
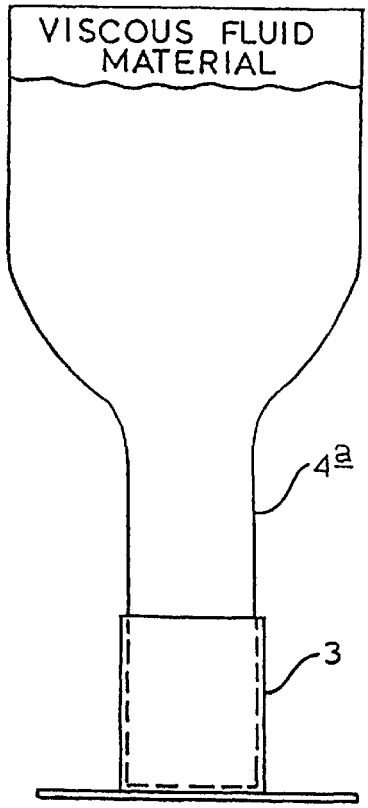
FIG. 4 is a perspective view of an inverted container in a holder.
Figure 3:
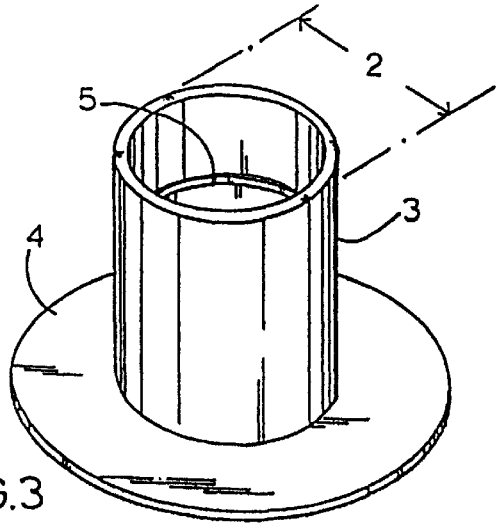
FIG. 3 is a perspective view of the holder shown in FIGS. 1 and 2.
Figure 5:
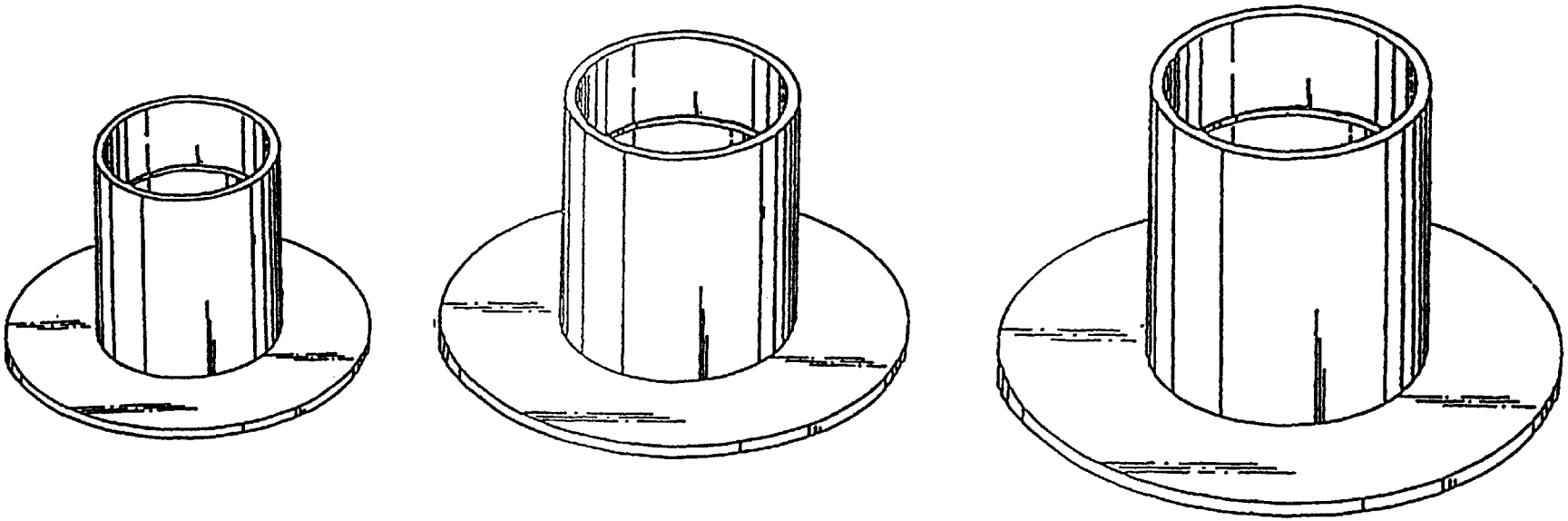
FIG. 5 is a perspective view of a set of inverted container holders in accordance with the present invention.

The opening of the cylindrical piece 3 is dimensioned for receiving inverted bottles/containers. For example, a salad dressing bottle 4*a* as shown in FIG. 4, can be inserted into the opening at the top of the cylindrical piece 3 with the head of the salad dressing bottle eventually resting on the base 4 and surrounded by the cylindrical piece 3. The salad dressing bottle is then held securely in an inverted position by ridges 5 and by the wall of tube 3. This allows the remaining contents thereof to be conveniently extricated from the salad dressing bottle when so desired by the consumer by virtue of the fact that in an inverted position the remaining salad dressing will collect in the top of the salad dressing bottle.

Numerous factors are important to consider in determining the inverted container holder configuration. For example, bottles come in many different sizes. Therefore, the holder should be dimensioned in such a way that it can accommodate as many different container shapes and sizes as possible. Also, refrigerator space is often quite limited. Therefore, the holder should be no larger than necessary and should not significantly elevate the bottle above its normal height. Further, the holder should support a bottle in a position where the center of gravity is as low as possible, i.e., therefore more stable. The holder should also be as manufacturable and simple in design as possible. The holder preferably does not require complex molds or custom fabricated pieces. Additionally, the holder should be made of a material and in a design which is easy to clean. Finally, it is essential that the holder provide adequate stability for an inverted bottle/container which has a center of gravity significantly above the top of the holder, and that the holder be able to maintain the inverted position of the bottle/container notwithstanding moderate lateral blows or forces applied from any side.

With these considerations in mind, we have experimentally determined that the following configuration ranges and ratios should be employed. The tube should have a diameter in the range of about X to about to 5/4X while the tube has a height in the range of about X to 3/2X, and the base has a diameter in the range of about 7/4X to 2X. In a preferred embodiment X=2 inches.

Another embodiment of the invention includes a set of inverted container holders, each holder having dimensions in the ranges stated above. In a first holder of the set, $X=X_1$. In a second holder of the set, $X=X_2$. In a preferred embodiment, the ratio of $X_1:X_2$ is approximately 9:5. This set of container holders provides the user with versatility for accommodating a wider range of bottle/container sizes. It is also sometimes useful to provide a third holder in the set for which $X=X_1$.

Figure 6:
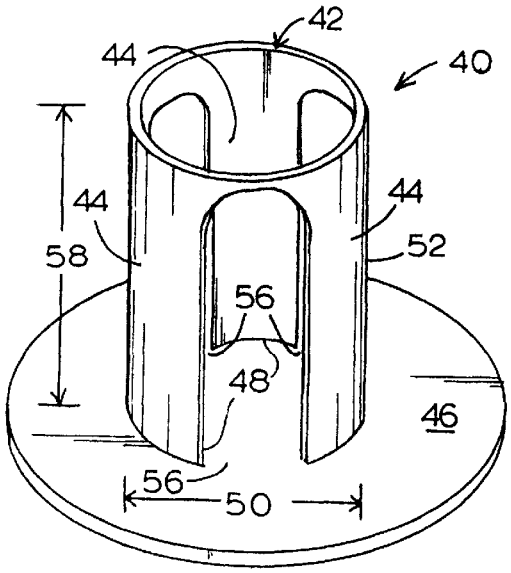
FIGS. 6, 7 and 8 show a perspective view of an alternative embodiment of the invention.

With references to FIG. 6, which is an overall drawing of a preferred embodiment of the invention, a holder for inverted bottles and containers 40 of the present invention includes a perimeter ridge 42 attached to three support pieces 44 configured to form a circle at its top perimeter ridge 42 and to extend down to its base 46 where a circular pattern 48 identical to the top perimeter circle 42 is defined. The diameter 50 of the space defined by the perimeter ridge 42 extending downward to the base 46 in a tubular fashion remains equal throughout the length of the tube 52. The diameter 50 of tube 52 is approximately one half of the diameter of base 46. For purposes of illustration, these drawings show a holder for inverted bottles and containers whose tube 52 is two inches in diameter, and whose base 46 is four inches in diameter, with a tube 52 height of two and one half inches. An opening 56 is formed between the base of each support piece 44 and the base of the other support pieces 44. This opening allows for the easy cleaning of the inverted container holder in the event that the base piece 46 should get dirty within the circular area at the bottom of the tube. The entire tube portion of the inverted container holder 58 is designed to be removable from the base piece 46 so as to allow for easy cleaning and storage of the inverted container holder.

Figure 7:
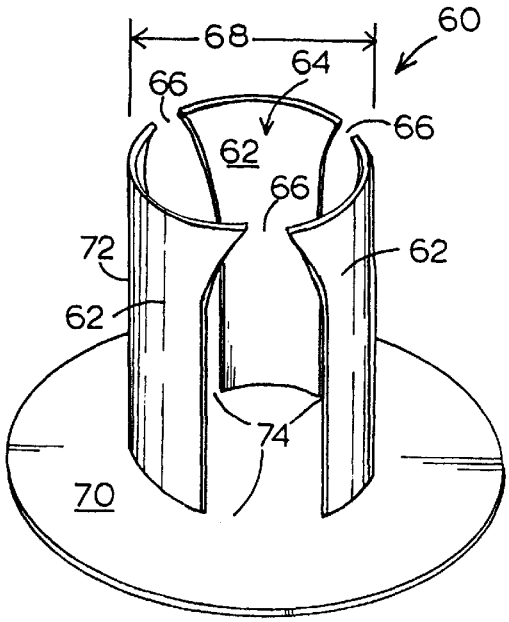

With reference to FIG. 7 which is an overall drawing of a preferred embodiment of the invention, a holder for inverted bottles and containers 60 of the present invention includes three support pieces 62 configured to form a circular opening 64 at the top perimeter ridge of the three support pieces 62. A gap 66 exists at the top of the three support pieces 62 such that the circular ridge formed by the top of the three support pieces 62 is not continuous in nature. The gaps 66 between the three support pieces 62 is small enough, however, so that the inverted container will not be able to fall through the gaps 66. The diameter 68 of the space defined by the perimeter ridge of the three support pieces 62 extending downward to the base 70 in a tubular fashion remains equal throughout the length of the tube 72 defined as the inner surfaces of the three support pieces 62. The diameter 68 of the tube 72 is approximately one half of the diameter of the base 70. For purposes of illustration, these drawings show a holder for inverted bottles and containers whose tube 72 is two inches in diameter, and whose base 70 is four inches in diameter, with a tube height of two and one half inches. An opening 74 is formed between the base of each support piece 62 and the base of the other support pieces 62. This opening allows for the easy cleaning of the inverted container holder in the event that the base piece 70 and the support pieces 62 should get dirty. The entire tube section, defined by the three support pieces 62 is designed to be removable from the base piece 70 so as to allow for easy cleaning and storage of the inverted container holder.

Figure 8:
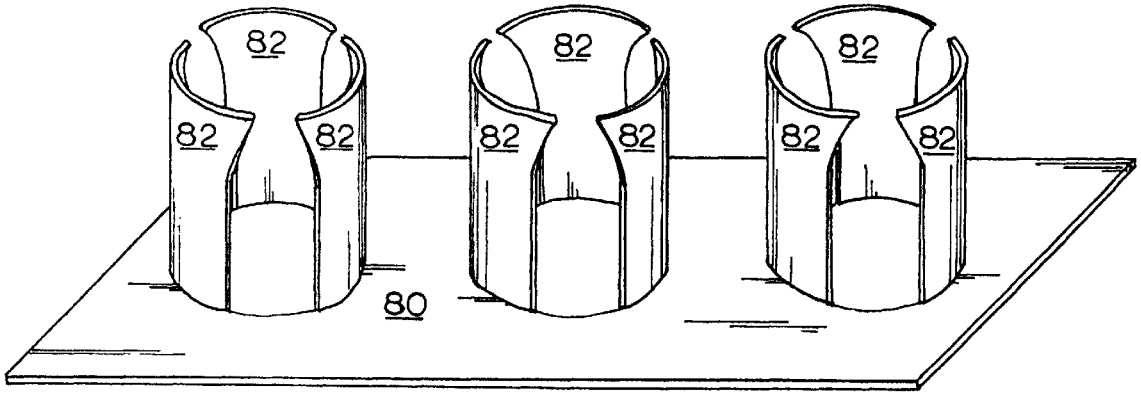

With respect to FIG. 8 which is an overall drawing of a preferred embodiment of the invention, a set of holders for inverted bottles and containers with all the attributes of those holders described in FIGS. 6 and 7 arranged in a set, and attached to a base piece 80. The dimensions of the base piece 80 is such that the width of the base piece 80 is approximately four inches wide, and long enough to accommodate the number of standing support pieces 82 attached to the base piece 80. The support pieces 82 are either fixed to the base piece in a permanent fashion, or they are removable. If they are removable, then the base piece is able to be stored in the refrigerator or other area of use, and not interfere with the other items on the shelf when the support pieces 82 are not attached to the base 80.

Figure 9:
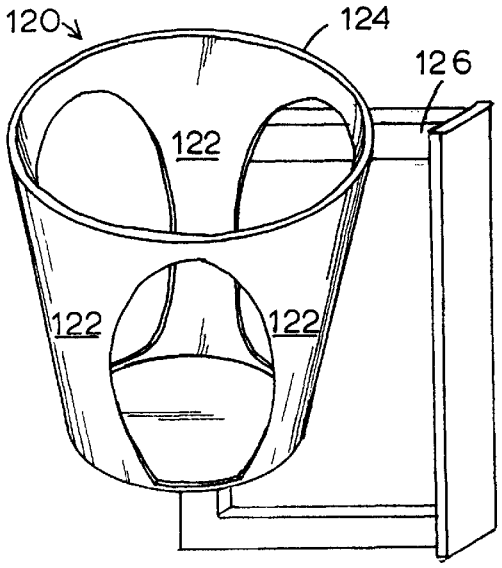
FIGS. 9, 10 and 11 show perspective views of an embodiment of the invention designed for use in a shower.
Figure 10:
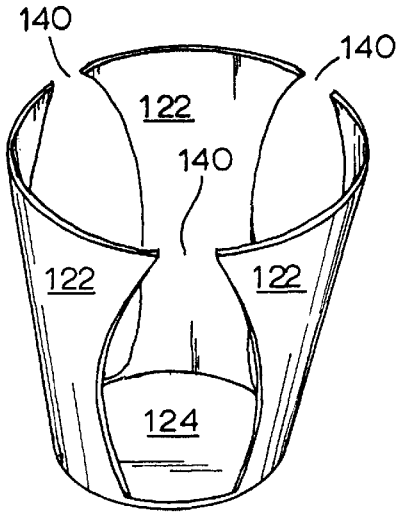

With reference to FIGS. 9 and 10 which are overall drawings of a preferred embodiment of the invention, a holder for inverted bottles and containers 120 of the present invention includes three or more support pieces 122 configured to form a circular opening 124 at the top perimeter ridge of the three or more support pieces 122. With reference to FIG. 10, a gap 140 exists at the top of the three support pieces 122 is not continuous in nature. The gaps 140 between the three support pieces 122 is small enough, however, so that the inverted container will not be able to fall through the gaps 140. The uppermost perimeter ridge of the support pieces 122 define a circle that is larger in circumference than the circle formed at the base of the three or more support pieces 122. The effect of this is to create a sloping angle from the wider top ridge of the support pieces 122 to the smaller base 124. The support pieces 122 define an opening at their base 124 that allows for the easy cleaning of the base piece 124. With reference to FIG. 9, a support bracket 126 is attached to the vertical support pieces 122 that allow the inverted container holder to be attached to a wall, particularly a shower wall, either by an adhesive fastener or through the use of screws or other fastening device. This allows for the secure storage of shampoo and other toiletry bottles in an inverted position while being stored in the shower area. In storing the shampoo and other similar bottles in an inverted position, the shampoo is more easily extricated from the bottle by the user by virtue of the fact that the shampoo or other similar relatively viscous product is forced by gravitational forces to migrate to the top of the shampoo container.

Figure 11:
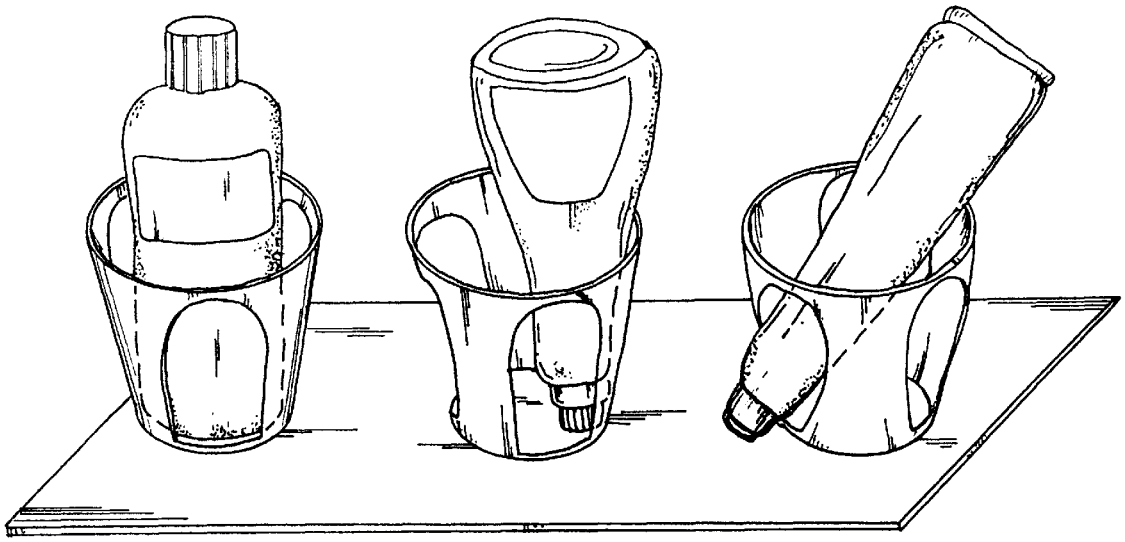

With reference to FIG. 11, a set of inverted container holders of the kind described in FIGS. 9 and 10 is shown. Said inverted container holders are attached to a base piece 128. The support portions of the inverted container holders can be removed from the base piece for cleaning and storage purposes.

The invention may be embodied in other specific forms without departing from the spirit or the essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. An inverted container holder system comprising a base having a top surface, a tube having a circular wall and a bottom edge joined to the top surface of the base, wherein the wall has at least one side opening, the tube being centrally positioned on the top surface of the base, wherein the base has a diameter that exceeds the diameter of the tube to stabilize the tube in an erect position when the tube is loaded with an inverted container without extra weight being added to the base or relying on any anchoring mechanism of the base;

a mostly empty container having an openable top and a bottom, the container being held securely in an inverted position by the tube, wherein the container contains some viscous material and has a center of gravity significantly above the top of the tube so that the viscous material can migrate by gravitational force from the bottom of the container toward the openable top inside the tube; and wherein said at least one opening is positioned and dimensioned large enough so that a person can easily see viscous material located near the top of the inverted container inside the tube.

2. The inverted container holder of claim 1 wherein the base is circular.

3. The inverted container holder of claim 1 wherein the base is square.

4. The inverted container holder of claim 1 wherein: (a) the tube has a diameter in the range of about X to 5/4X, (b) the tube has a height in the range of about X to 3/2X, and (c) the base has a diameter in the range of about 7/4X to 2X.

5. The inverted container holder of claim 4 wherein X=2 inches.

6. A set of inverted container holders comprising:

a first holder, as recited in claim 4, for which $X=X_1$; and a second holder, as recited in claim 4, for which $X=X_2$, wherein the ratio of $X_1:X_2$ is approximately 9:5.

7. The set of claim 6 further comprising a third holder, as recited in claim 4, for which $X=X_1$.

* * * * *